US006390660B1

(12) United States Patent
Colin

(10) Patent No.: US 6,390,660 B1
(45) Date of Patent: May 21, 2002

(54) METHOD AND DEVICE FOR SUSPENDING SOLID PARTICLES IN A LIQUID

(75) Inventor: Bruno Colin, Marcy L'Etoile (FR)

(73) Assignee: Bio Merieux, Marcy L'Etoile (FR)

( * ) Notice: Subject to any disclaimer, the term of this patent is extended or adjusted under 35 U.S.C. 154(b) by 0 days.

(21) Appl. No.: 09/381,796

(22) PCT Filed: Mar. 27, 1998

(86) PCT No.: PCT/FR98/00639

§ 371 Date: Oct. 15, 1999

§ 102(e) Date: Oct. 15, 1999

(87) PCT Pub. No.: WO98/43730

PCT Pub. Date: Oct. 8, 1998

(30) Foreign Application Priority Data

Mar. 27, 1997 (FR) ..... 97 04017

(51) Int. Cl.[7] ..... B70F 11/00

(52) U.S. Cl. ..... 366/116; 366/108; 366/203; 366/212

(58) Field of Search ..... 366/108, 110, 366/111, 112, 116, 212, 240, 218, 203, 237

(56) References Cited

U.S. PATENT DOCUMENTS

| | | | | | |
|---|---|---|---|---|---|
| 1,417,219 | A | * | 5/1922 | Warren | 366/212 |
| 1,999,671 | A | * | 4/1935 | Van Bree et al. | |
| 2,198,637 | A | * | 4/1940 | Smith | 366/108 |
| 2,561,027 | A | * | 7/1951 | Liesch | 366/108 |
| 2,766,881 | A | * | 10/1956 | Westervelt et al. | 366/108 |
| 3,498,384 | A | * | 3/1970 | Ogura | 366/108 |
| 3,587,193 | A | * | 6/1971 | Lewis | 366/111 |
| 3,764,116 | A | * | 10/1973 | Fuller et al. | 366/108 |
| 4,085,955 | A | * | 4/1978 | Salle | 366/212 |
| 4,316,672 | A | * | 2/1982 | Kerscher | 366/212 |
| 4,556,639 | A | * | 12/1985 | Izawa et al. | 366/240 |
| 4,778,278 | A | * | 10/1988 | Vanvoren et al. | 366/108 |
| 4,841,848 | A | * | 6/1989 | Baker et al. | 366/240 |
| 4,895,453 | A | * | 1/1990 | Devlin et al. | 366/219 |
| 5,272,092 | A | * | 12/1993 | Hamasaki et al. | 436/172 |
| 5,273,357 | A | * | 12/1993 | Currie | 366/212 |
| 5,316,053 | A | * | 5/1994 | Waber | 366/212 |
| 5,833,362 | A | * | 11/1998 | Shepard | 366/240 |

FOREIGN PATENT DOCUMENTS

| | | | | |
|---|---|---|---|---|
| DE | 560 885 | * | 9/1932 | 366/110 |
| DE | 1 457 328 | | 10/1969 | |
| DE | 3 0 46 157 | * | 2/1982 | 366/108 |
| DE | 32 33 926 A1 | | 4/1983 | |
| EP | 0 187 324 | * | 7/1986 | 366/108 |
| GB | 1 330 975 | | 9/1973 | |
| JP | 2-256434 | * | 10/1990 | 366/108 |
| JP | A-6-58235 | | 6/1994 | |

* cited by examiner

*Primary Examiner*—Tony G. Soohoo
(74) *Attorney, Agent, or Firm*—Oliff & Berridge, PLC

(57) ABSTRACT

In a method and apparatus for suspending solid particles in a predetermined volume of liquid contained inside a container having a wall, the wall being partly isolated from the liquid by a deposit adhering to its internal face, and bringing together at least some of the particles in the agglomerated state, the container is subjected to a reciprocating movement along a reference axis, at a frequency adapted to cause within the predetermined volume of liquid, without any other external action, an ebb and flow on either side of the reference axis, detaching the deposit, and dispersing the particles toward the center of the volume of liquid.

16 Claims, 2 Drawing Sheets

METHOD AND DEVICE FOR SUSPENDING SOLID PARTICLES IN A LIQUID

BACKGROUND OF THE INVENTION

1. Field of Invention

The invention relates to the suspension of solid particles in a predetermined volume of liquid, the particles and the volume of liquid being contained together inside a container which is itself delimited by a wall and to the suspension or resuspension of particles, forming a deposit adhering to the internal face of the wall of the container, in the form of a continuous film or of aggregates, and bringing together at least some of these particles in the agglomerated state, and doing so in a predetermined volume of the liquid, contained inside the container.

2. Description of Related Art

The physical state of particles /liquid defined above is encountered in particular in certain biological analyses, using particles of a size equal to no more than 10 $\mu$m, and preferably of between 0.01 $\mu$m and 10 $\mu$m, for example between 1 and 5 $\mu$m, these particles comprising a magnetic substrate on which there is fixed at least one analyte, or at least one reagent, and being dispersed in a continuous liquid phase, for example an aqueous phase. In fact, the separation of these particles, under the effect of a magnetic field, from the liquid phase leads in part to their accumulation and agglomeration in the form of a continuous or discontinuous deposit adhering to the internal face of the wall of the container. In such cases, in order to continue the analysis and obtain reliable, reproducible and precise results, it is essential to break up the deposit in order to resuspend the particles in the predetermined volume of the liquid, in the container, for example a micro vessel for analysis, as otherwise the particles collected, and to an extent separated off in the deposit on the wall, cannot participate in the remainder of the analysis process or protocol.

The deposit of agglomerated particles on the wall of the container is conventionally broken up by introducing a complementary flow of liquid, for example under pressure, into the container, and more precisely into the liquid volume, in such a way as to entrain and suspend the previously agglomerated particles, by hydrodynamic action. This solution has the major disadvantage of adding to the container a certain quantity of liquid phase which, even if controlled or predetermined, brings about a dilution of the particles, which dilution reduces the sensitivity of the analysis procedure used.

GB-A-1 330 975 and DE-A-3 233 926 disclose a method for suspending solid particles in a predetermined volume of liquid, contained inside a container delimited by a wall, which latter may become partly isolated from the heart of the liquid by a deposit adhering to its internal face, and bringing together at least some of the particles in the agglomerated state. According to this method, the container is simultaneously subjected to a reciprocating movement along a reference axis and to a magnetic field turning about the said reference axis.

The previously described method is specific to magnetic particles and can be used only with such particles, since it is the conjunction of the rotational movement of the particles, generated by the rotating magnetic field, and the relative reciprocating translational movement, between the field and the container, which detaches and disperses any deposit of the magnetic particles likely to agglomerate on the internal face of the container.

SUMMARY OF THE INVENTION

An object of the invention is therefore a method for suspending particles, starting from the physical state described or defined above, independently of the nature of the particles, and mechanically or hydrodynamically, without introducing a supplementary quantity of liquid into the container.

According to the invention, it has been discovered, in a totally surprising manner, that by subjecting the container exclusively to a reciprocating movement along a reference axis, and at a relatively high frequency, at least equal to 10 Hz, produces, within the predetermined volume of liquid, and without any other external action being needed (in particular a magnetic field), an ebb/flow resonating against the wall of the container on either side of the reference axis, breaking up the deposit adhering to the internal face of the wall of the container, and dispersing the broken up particles toward the center of the volume of liquid.

Thus, by means of the invention, it is possible to completely break up the parasitic deposit with the sole aid of the volume of liquid contained in the container, this remaining constant and predetermined.

The solution according to the invention affords another advantage too.

The maximum height of the ebb/flow obtained according to the present invention makes it possible to mechanically sweep and detach agglomerated particles from the internal face of the container above the normal level (at rest) of the liquid contained in the said container, even with a small quantity of liquid.

BRIEF DESCRIPTION OF THE DRAWINGS

The invention is now described with reference to the attached drawings, in which:

(FIG. 4: Estapor particles, FIG. 5: Dynal particles, FIG. 6: Seradyn particles). The measurement of the light signal is expressed in RLUs (Relative Light Units).

DETAILED DESCRIPTION OF PREFERRED EMBODIMENTS

Figure 1:
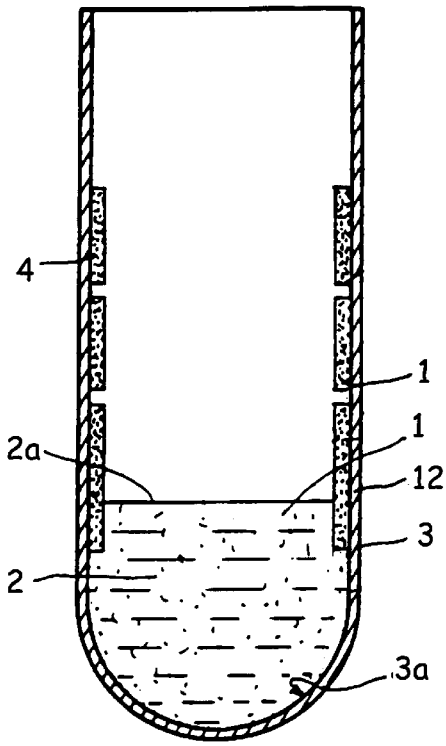
FIG. 1 is a diagrammatic representation of a container, in the physical state of its different phases before application of the method according to the invention.
Figure 3:
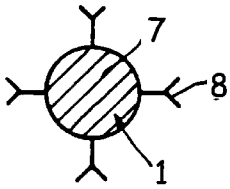
FIG. 3 is a diagrammatic representation of the particles as used in the invention.
Figure 2:
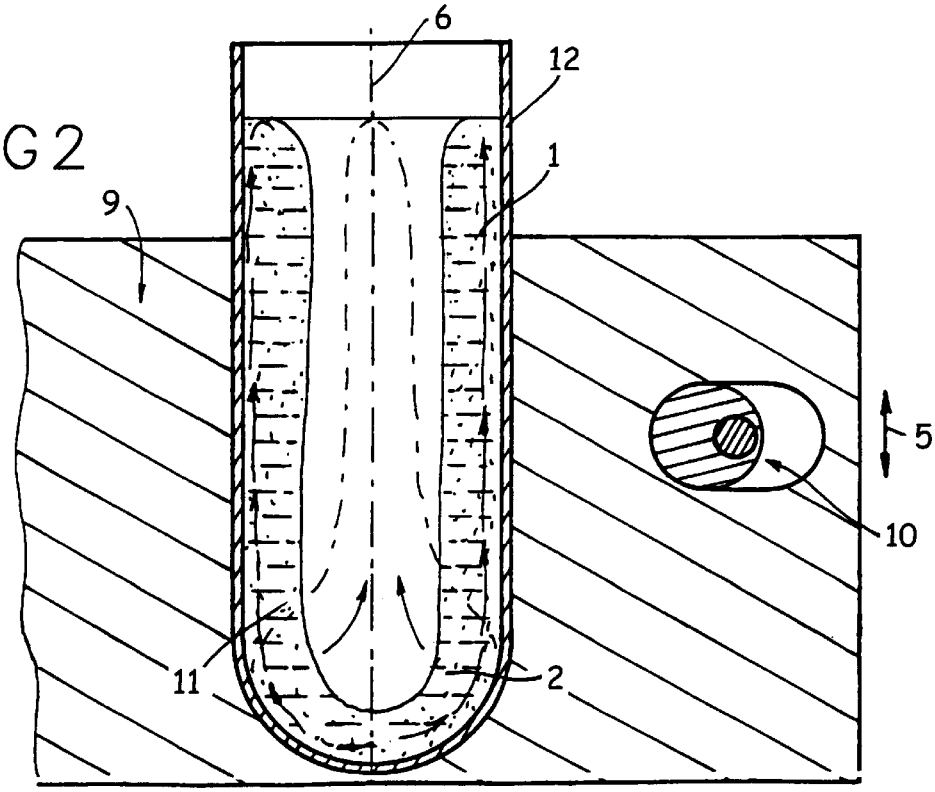
FIG. 2 shows the same container during the implementation of the method according to the invention.

According to the invention, a container 12 includes a wall 3 having an internal face 3*a*. The container 12 contains a predetermined volume of liquid 2, for example a reagent in liquid form, and solid particles 1, for example particles such as those shown diagrammatically in FIG. 3, each made up of a magnetic substrate 7, on which is fixed for example a ligand 8, attached to an analyte. However, the implementation of the invention is independent of the magnetic or nonmagnetic nature of the particles 1. Before implementing the method according to the invention, because of a treatment which consists in applying a magnetic field, for example in the area of the side walls of the container 12, the particles 1 are either entirely grouped together and agglomerated in the form of a deposit 4 adhering to the internal face 3*a* of the wall 3, or are in part dispersed within the volume of liquid 2 and in part grouped together and agglomerated in the form of a deposit 4, as described above. In the state shown in FIG. 1, and before implementing the method according to the invention, because of the prior treatment mentioned above, the particles 1 are in part dispersed within the volume of liquid 2 and in part remain grouped together and agglomerated in the form of a deposit 4 (continuous film or aggregates) adhering to the internal face 3*a* of the wall 3.

For implementing the method according to the invention, there is a means 9 for securing the container 12 and a means 10 for reciprocating displacement of the securing means 9 along a reference axis 6, for example a vertical axis. The reciprocating means 10 may include, for example, a simple crank acting on the securing means 9.

According to the method of the invention, and with the means defined above, the container 12 is subjected to a reciprocating movement 5 along the reference axis 6, with a relatively high frequency, at least equal to 10 Hz, and one obtains or observes, within the predetermined volume of liquid 2, an ebb/flow 11 against the wall 3 of the container 12 on either side of the reference axis 6, breaking up the deposit 4 and dispersing the particles 1 toward the center of the volume of liquid 2.

On stopping the reciprocating movement 5, the predetermined volume of liquid 2 contains the particles 1 in a homogeneous and completely dispersed state, such that the analysis procedure can be continued.

As regards the reciprocating movement:

its amplitude is between 1 mm and 15 mm, preferably between 1 mm and 8 mm, and for example between 3 mm and 6 mm, the reciprocating movement has a frequency of preferably between 15 Hz and 60 Hz, for example between 15 Hz and 30 Hz, by way of example, the preferred frequency is 16 Hz, the reference axis 6 of the reciprocating movement 5 is preferably vertical, that is to say perpendicular to the horizontal interface 2*a* of the predetermined volume of liquid 2; but the reference axis 6 of the reciprocating movement 5 may include a principal vertical component and a secondary horizontal component.

EXAMPLE

The invention has been used in a quantitative analysis of a pathogenic microorganism, namely Toxoplasma M (analyte), with magnetic particles coated with a ligand (antibody) specific to the said microorganism.

The particles are incubated in an analysis dish (container), with a sample or inoculum containing the microorganism. Those particles that have reacted with the microorganism are then separated off by means of a magnetic field, bringing them together and fixing them against the wall of the dish. The dish is then emptied, then washed. A predetermined volume of a reagent (antibody labeled for example with an enzyme such as alkaline phosphatase directed against the analyte) is then introduced into and incubated in the dish after removal of the magnetic field. After incubation and separation of those elements which have not reacted, a luminescent detection reagent is introduced into the dish. The light signal corresponding to the reagent which has reacted with the particles is measured.

The resuspension of the particles according to the method and the device of the invention facilitates the contact of the particles with the reactive entities (analyte and/or detection reagent), which translates into an increase in the measured signal, for example the light signal. Other things being equal, implementation of the suspension or resuspension according to the invention makes it possible to increase the measured light signal by at least 60%, in some cases even by the order of 100%, depending on the magnetic particles used, for example with the trade names Estapor $NH_2$-gluta, Dynal M280 and Seradyn.

The results with and without agitation are presented below for each respective type of particle.

Figure 4:
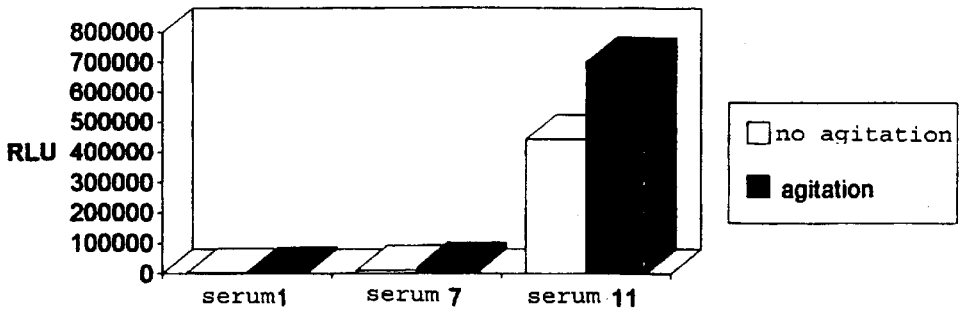
FIGS. 4, 5 and 6 represent, respectively, the influence of the agitation on the values of signals obtained for different types of particles
Figure 5:
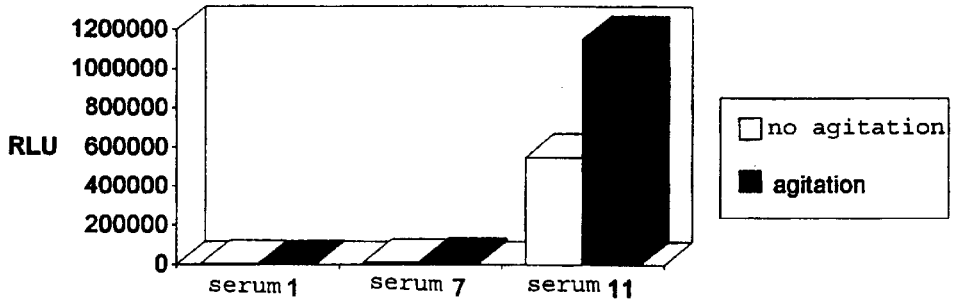
Figure 6:
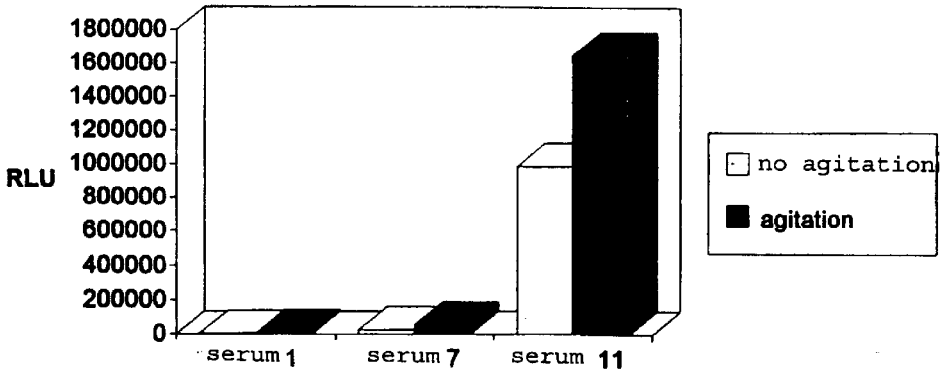

As will be clear from FIGS. 4, 5 and 6 and from the following results tables, agitation significantly increases the light signal obtained, thereby improving the performance of the biological assay.

| | No agitation (RLU) | Agitation (RLU) |
|---|---|---|
| | Estapor particles | |
| Serum 1 | 3930 | 7403 |
| Serum 7 | 12592 | 21596 |
| Serum 11 | 443490 | 703030 |
| | Dynal M280 particles | |
| Serum 1 | 3602 | 5713 |
| Serum 7 | 11587 | 19692 |
| Serum 11 | 549313 | 1153317 |
| | Seradyn particles | |
| Serum 1 | 5614 | 10201 |
| Serum 7 | 28178 | 58322 |
| Serum 11 | 990900 | 1651945 |

What is claimed is:

1. A method for resuspending solid particles in a predetermined and a same volume, of liquid, comprising:

providing a container having a longitudinal axis and a side wall around the axis for containing the same volume of the liquid and solid particles, having a size equal to or less than 10 $\mu$m, forming a deposit adhering in an agglomerated state to an internal face of the side wall, wherein the solid particles separate the side wall from the same volume of liquid;

subjecting the container to a reciprocating movement along a reference axis substantially parallel to the longitudinal axis using reciprocating means to which the container is fixed; and monitoring at least the frequency of the reciprocating means to cause, in the container with the same volume of liquid, a reciprocating ebb and flow on either side of the reference axis, thereby detaching the deposit from the internal face of the side wall and dispersing the solid particles thus detached back toward the center of the same volume of liquid.

2. The method according to claim 1, wherein the solid particles are smaller than 10 $\mu$m.

3. The method according to claim 1, wherein the solid particles are between 0.01 $\mu$m and 10 $\mu$m.

4. The method according to claim 1, wherein the solid particles are between 1 $\mu$m and 5 $\mu$m.

5. The method according to claim 1, wherein the particles are comprised of a magnetic substrate on which at least one ligand is fixed.

6. The method according to claim 1, wherein the liquid is a continuous dispersion phase of the solid particles.

7. The method according to claim 6, wherein the continuous dispersion phase is an aqueous phase.

8. The method according to claim 1, wherein the reciprocating movement has an amplitude of between 1 mm and 15 mm.

9. The method according to claim 8, wherein the amplitude is between 1 mm and 8 mm.

10. The method according to claim 8, wherein the amplitude is between 3 mm and 6 mm.

11. The method according to claim 1, wherein the reciprocating movement has a frequency of between 15 Hz and 60 Hz.

12. The method according to claim 11, wherein the frequency is between 15 Hz and 30 Hz.

13. The method of claim 11, wherein the frequency is 16 Hz.

14. The method according to claim 1, wherein the predetermined volume of liquid defines a horizontal interface and the at least one reference axis is vertical.

15. The method according to claim 1, wherein the predetermined volume of liquid defines a horizontal interface and the at least one reference axis includes a vertical component and a horizontal component.

16. The method according to claim 15, wherein the vertical component is a major component of the at least one reference axis and the horizontal component is a minor component of the at least one reference axis.

* * * * *